United States Patent [19]

Dodge et al.

[11] 4,274,697

[45] Jun. 23, 1981

[54] GROUND PIN BLADE AND ELECTRICAL CONNECTOR PLUG

[75] Inventors: Donald M. Dodge, Huntington Beach; Ernest Dietz, Torrance, both of Calif.

[73] Assignee: Pacific Electricord Company, Gardena, Calif.

[21] Appl. No.: 93,740

[22] Filed: Nov. 13, 1979

[51] Int. Cl.[3] ..... H01R 13/04

[52] U.S. Cl. ..... 339/103 R; 339/14 P; 339/218 R

[58] Field of Search ..... 339/14 R, 14 P, 14 RP, 339/218 R, 218 M, 275 R, 276 SF, 103 R, 105, 106

[56] References Cited

FOREIGN PATENT DOCUMENTS

| | | | |
|---|---|---|---|
| 530711 | 8/1954 | Belgium | 339/218 R |
| 1020395 | 12/1957 | Fed. Rep. of Germany | 339/218 R |
| 1138161 | 1/1957 | France | 339/218 R |

*Primary Examiner*—Eugene F. Desmond

*Attorney, Agent, or Firm*—Fulwider, Patton, Rieber, Lee & Utecht

[57] ABSTRACT

There is disclosed a ground pin blade having an improved design having a vastly enhanced resistance to fatigue failure. There is also disclosed a molded electrical connector plug utilizing the ground pin blade. The ground pin blade is a channel-shaped member having the sidewalls of its end which is embedded in the molded plug body flared outwardly from a channel shape to an included side wall angle of about 90 degrees. The channel member has an aperture in its bottom wall adjacent the transition between the flared and unflared portion and this aperture receives the electrical conductor for the ground conductor of the electrical cord. The ground pin blade is intended primarily for use in a molded-on, electrical plug useful in life support equipment and, for this purpose, a plurality of strain relief members are used to firmly secure the assembly of the molded plug and electrical conductors.

13 Claims, 7 Drawing Figures

GROUND PIN BLADE AND ELECTRICAL CONNECTOR PLUG

BACKGROUND OF THE INVENTION

One of the requirements for electrical cords and plugs used in life support equipment such as in hospitals is that the plug and cord assembly have a strength resisting separation which is equal to or greater than the strength of the electrical conductors. Until recently, the only assembly which met this requirement was an assembled plug. In copending application, Ser. No. 697,143 filed June 17, 1976, now U.S. Pat. No. 4,181,394, is disclosed and claimed a molded-on plastic plug body which utilizes a combination of strain relief members which have been found sufficient to achieve the aforementioned strength requirement.

Extensive testing of the aforementioned electrical cord and molded plug have revealed that a conventional ground pin blade can, under extraordinary abuse, fracture within the molded plug body. The conventional ground pin blade is a channel-shape member having the sidewalls of the portion of its length within the molded plastic body flatted to provide retention of the blade in the molded plastic body. Some failures of this plug have occurred under abusive and extraordinary treatment wherein the flatted portion of the channel blade fractured by fatigue failure, typically fracturing in the transition of the ground blade between its flat and channel portions.

BRIEF STATEMENT OF THE INVENTION

This invention comprises a ground pin blade of an improved design and an electrical molded conductor plug utilizing the blade. The blade is a channel member having parallel sidewalls and an arcuate bottom wall along a major portion of its length. At one end and extending for approximately 30 to 40 percent of the length of the blade, the sidewalls are flared outwardly in a continuously expanding flare, to a maximum, included angle between the sidewalls of between 60 and 120 degrees. The aperture which receives the electrical conductor is located in the region adjacent the transition between the flared and unflared portions, preferably in the unflared channel portion of the blade. The blade is employed as a ground pin blade for a molded plastic plug, preferably a plug which is acceptable for life support equipment and which has a number of strain relief members in the end of the cord which is received in the molded plastic body to enhance retention of the cord jacket and electrical conductors within the molded body. The strain relief members include knots in each of the individual insulated conductors and slotted bushings with annular flanges crimped about the jacket of the conductor.

BRIEF DESCRIPTION OF THE DRAWINGS

The invention will be described with reference to the FIGURES of which.

DESCRIPTION OF PREFERRED EMBODIMENTS

Figure 1:
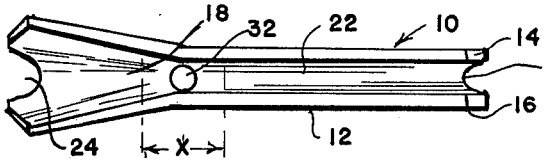
FIG. 1 is a plan view of the ground pin blade of the invention.
Figure 2:
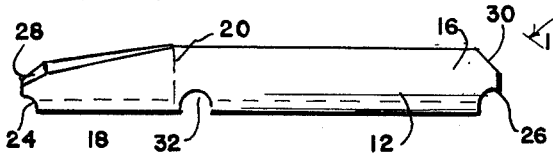
FIG. 2 is a side elevational view of the blade of FIG. 1.
Figure 3:
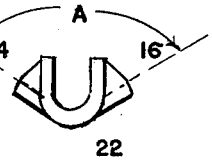
FIG. 3 is an end view of the ground pin blade of FIG. 1.

Referring to FIGS. 1-4, the ground pin blade of the invention is formed of a channel member 10 having parallel sidewalls 14 and 16 along a major portion 12 of its length. At one end, and extending for approximately 30-40 percent of its length, the blade has a flared portion 18 which extends from a transition junction 20 with the unflared portion 12 in a continuously expanding flare. As illustrated in FIG. 3, the outwardly expanding flared sidewalls open to a maximum included angle A which is from 60 to 120 degrees, preferably about 90 degrees. Also as shown in FIG. 3, the channel has a generally arcuate bottom wall 22 which continues the entire length of the blade.

As shown in FIGS. 1 and 2, the blade ends include semi-circular notches 24 and 26 in the bottom wall and the sidewalls have bevelled ends such as 28 and 30 which are at approximately 45 degrees.

In use, an electrical conductor is attached to the ground pin blade 10 and, to this end, an attachment aperture 32 is provided in the bottom wall 22 of the channel blade 10. Preferably, the aperture 32 is provided adjacent the transition junction 20 between the flared and unflared portions and, most preferably, is positioned in the unflared portion 12 of the channel member 10. This aperture can also be located slightly in the flared portion, e.g., within the first 35 percent of the length of the flared portion beyond the transition junction 20, in the area generally designated as X in FIG. 1.

Figure 5:
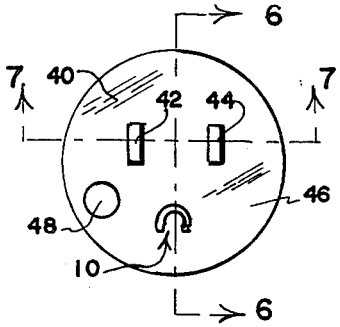
FIG. 5 is an end view of an electrical molded plug utilizing the ground pin blade of FIG. 1.
Figure 4:
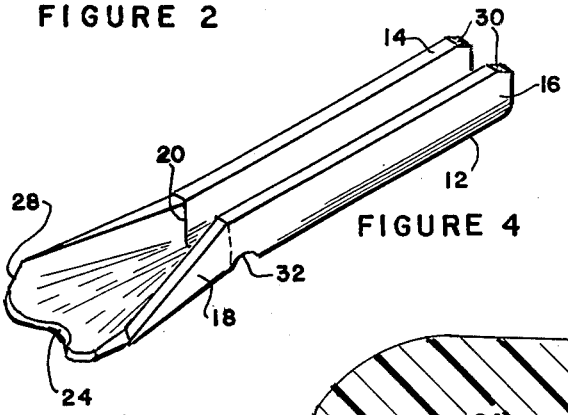
FIG. 4 is a perspective view of the ground pin blade of FIGS. 1-3.

Referring now to FIG. 5, there is illustrated an end view of an electrical connector plug 40 which utilizes the ground pin blade 10 of the invention. The attachment plug has the conventional contact elements which are the pair of flat-bladed prongs 42 and 44. Plug 40 is a generally cylindrical body. The terminal end of the attachment plug 40 has a flat face 46 and can bear a conventional indicia 48 and/or other markings to indicate approval of the construction for particular applications, e.g., for hospital and life support equipment.

Figure 6:
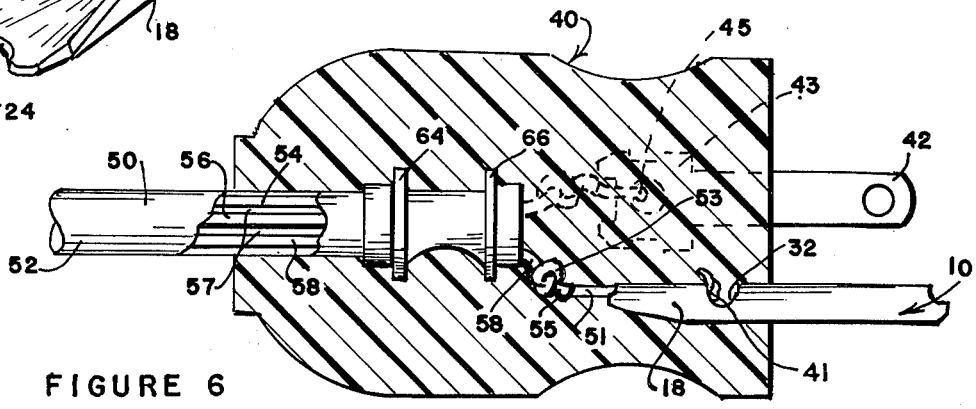
FIG. 6 is a sectional view along lines 6—6 of FIG. 5.

Referring now to FIG. 6, the assembly of the molded electrical plug 40 with an electrical conductor cord 50 and the electrical contact prongs such as 42 and the ground pin blade 10 of the invention is illustrated. The electrical cord 50 has a conventional outer jacket 52 with a plurality of single conductors 54, 56 and 58. The single conductors are interspaced within the jacket 52 by separators such as 57 of insulating material such as paper, jute, Nylon, etc. The single conductors bear separate insulation as shown by insulation 55 which extends about conductor 58 which is shown in attachment to the ground pin blade 10 of the invention.

The single conductors 54, 56 and 58 extend out of the jacket 52 and bear individual strain relievers such as knots 53 which can be simple overhand knots. The ends of the conductors are stripped of insulation and extend into contact in attachment to the spaced-apart, flat-blade prongs 42 and 44 and the ground pin blade 10. These exposed ends of the single conductors, such as end 51, are engaged with the connecting terminals of these contact members such as the flat, square-shouldered portion 43 of the flat blade prong 42 or the flared portion 18 of the ground pin blade 10. The exposed conductor end 51 is received in aperture 32 of the ground pin blade 10 and is secured therein by a solder joint 41. A similar attachment is provided in the ends of the other conductors such as shown at 45 for the flat-blade prong 42.

Figure 7:
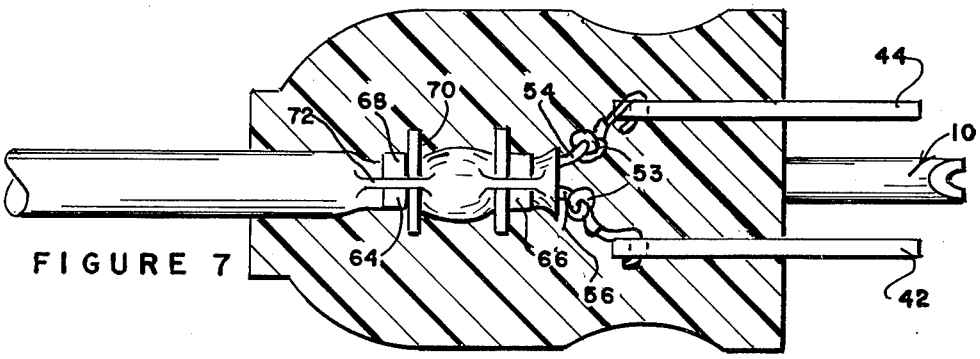
FIG. 7 is a sectional view along lines 7—7 of FIG. 5.

The jacket 50 of the electrical cord also bears strain relief bushing means of one or more bushings such as 64 and 66. Preferably two bushings are used to obtain the necessary strain relief. Each bushing comprises a sleeve portion 68 which extends about the jacket of the cord and an annular dependent flange 70. As shown in FIG. 7, these bushings have axial slots such as 72 which permit the bushings to be crimped about the jacket of the cord in the manner shown in FIG. 7. FIG. 7 also illustrates that each pair of the conductors 54 and 56 also bear the knots 53 in the form of simple overhand knots which are spaced intermediate of the bushings 64 and 66 and the contact elements 42 and 44.

The length of the molded body 40 of the attachment plug is sufficient that the strain relief bushings 64 and 66 as well as knots 53 are embedded in the central portion of the plug body, thereby insuring maximum retention strength of the retaining strain relieving members within the molded body. It has been found that the aforementioned construction provides an assembly of an electrical cord and molded cord plug having a strength which exceeds the tensile strength of the cord 50 and which has a vastly improved resistance to fatigue failure. The strain relief members are effective to retain the assembly such that application of excessive stress to the assembly will rupture the cord 50 rather than separate any of the conductors from their respective contact element or separate the cord jacket from the plug 40.

The ground pin blade of the invention having the particular, limited degree of flare in the flared portion 18 of its length has a vastly increased resistance to fatigue failure than the conventionally-shaped ground pin blades wherein the contact portion received within the molded plug is completely flatted. The strength of the plug and ground pin blade to fatigue failure is further enhanced by utilization of molding compounds for forming the plastic body 40 which have a high hardness value. Preferably, the molding compounds which are used are polyvinylchloride resin based. Most preferably, both the plug and the cord jacket are formed of polyvinylchloride resin to achieve maximum adhesion between these parts.

Preferably, the molding compounds which are used for the plug have a hardness value greater than about 90 A, typically from 90 A to about 95 A, Shore durometer values. The combination of the high hardness molding compound used for body 40 and the limited degree of flare in the received portion of the ground pin blade 10 achieves a fatigue resistant assembly which is vastly superior to prior assemblies.

The invention has been described with reference to the illustrated and presently preferred embodiment. It is not intended that the invention be limited by this description of preferred embodiments. Instead, it is intended that the invention be defined by the means, and their obvious equivalents, set forth in the following claims.

What is claimed is:

1. A ground pin blade for a molded electrical plug, said blade comprising:

an elongated channel having an arcuate bottom, and further having side walls which are parallel throughout a first channel portion extending from the outer end of said channel to a transition section, the upper edges of said side walls progressively flaring laterally outwardly throughout a second channel portion extending from said transition section to the inner end of said channel, the included angle defined between said side walls at said inner end being between 60 and 120 degrees, the length of said second channel portion being between 30 and 40 percent of the length of said channel; and a wire conductor aperture extending through said bottom of said channel and located somewhere along the length of an aperture region which includes that part of said first channel portion adjacent said transition section, and which further includes that part of said second channel portion adjacent said transition section and constituting no more than 35 percent of the length of said second channel portion.

2. The ground pin of claim 1 wherein said outer end and said inner end of said channel bottom each includes a semi-circular notch.

3. The ground pin of claim 2 wherein said outer end and said inner end of said sidewalls are chamfered.

4. The ground pin of claim 1 wherein said included angle is no greater than 90 degrees.

5. The ground pin of claim 1 wherein said length of said second channel portion is greater than 34 percent of the length of said channel.

6. The ground pin of claim 1 wherein said aperture is located in said first channel portion adjacent said transition section.

7. In a molded electrical plug having a molded plastic body receiving an electrical cable having an outer jacket and a plurality of single conductors bearing electrical insulation and extending outwardly from said jacket to respective attachments to each of a pair of flat-bladed prongs and a ground pin blade, the improvement comprising a ground pin blade formed of:

an elongated channel having an arcuate bottom, and further having side walls which are parallel throughout a first channel portion extending from the outer end of said channel to a transition section, the upper edges of said side walls progressively flaring laterally outwardly throughout a second channel portion extending from said transition section to the inner end of said channel, the included angle defined between said side walls at said inner end being between 60 and 120 degrees, the length of said second channel portion being between 30 and 40 percent of the length of said channel; and a wire conductor aperture extending through said bottom of said channel and located somewhere along the length of an aperture region which includes that part of said first channel portion adjacent said transition section, and which further includes that part of said second channel portion adjacent said transition section and constituting no more than 35 percent of the length of said second channel portion.

8. The molded electrical plug of claim 7 including the further improvement of a body molded of a plastic having a hardness greater than 90 A, Shore durometer value.

9. The molded electrical plug of claim 8 wherein said included angle is no greater than 90 degrees.

10. The molded electrical plug of claim 8 wherein the length of said second channel portion is less than 34 percent of the length of said channel.

11. The molded electrical plug of claim 7 wherein each of said conductors has a knot adjacent its end and embedded in said molded plastic body.

12. The molded electrical plug of claim 11 wherein said jacket has a slotted bushing having an annular flange crimped onto its end and embedded in said molded plastic body.

13. The molded electrical plug of claim 12 including a pair of said slotted bushings crimped onto the end of said jacket and embedded in said molded plastic body.

* * * * *